United States Patent [19]

Furuta

[11] Patent Number: 4,961,450

[45] Date of Patent: Oct. 9, 1990

[54] TONER CARTRIDGE

[75] Inventor: Haruo Furuta, Kanagawa, Japan

[73] Assignee: Fuji Xerox Co., Ltd., Tokyo, Japan

[21] Appl. No.: 349,287

[22] Filed: May 9, 1989

[30] Foreign Application Priority Data

Jun. 20, 1988 [JP] Japan ..... 63-149953

[51] Int. Cl.[5] ..... B65D 25/38; B65D 43/02

[52] U.S. Cl. ..... 141/364; 141/352; 141/360; 206/631; 222/325; 222/541; 222/DIG. 1

[58] Field of Search ..... 355/260, 245, 326; 141/1, 89, 312, 319–322, 346, 372, 351–354, 360, 375, 362–366, 369, 370, 383, 386; 222/325, 541, 561, DIG. 1; 206/527, 813, 631.1, 631.2, 631, 633; 220/346; 229/87 R, 125.35, 123.1, 123.2

[56] References Cited

U.S. PATENT DOCUMENTS

| | | | |
|---|---|---|---|
| 1,175,738 | 3/1916 | Fischer | 229/87 R |
| 3,207,415 | 9/1965 | Schechter | 229/125.35 |
| 3,217,871 | 11/1965 | Lee | 206/633 |
| 3,290,856 | 12/1966 | Rumberger | 229/125.35 X |
| 4,062,385 | 12/1977 | Katusha et al. | 141/89 |
| 4,411,365 | 10/1983 | Horikawa et al. | 206/633 X |
| 4,614,286 | 9/1986 | Yamaguchi et al. | 222/505 |
| 4,834,246 | 5/1989 | Inoue et al. | 206/631 |

FOREIGN PATENT DOCUMENTS

| | | | |
|---|---|---|---|
| 58-224364 | 12/1983 | Japan . | |
| 59-77151 | 5/1984 | Japan . | |
| 60-147769 | 8/1985 | Japan | 355/260 |

*Primary Examiner*—Henry J. Recla
*Assistant Examiner*—Casey Jacyna
*Attorney, Agent, or Firm*—Finnegan, Henderson, Farabow, Garrett, and Dunner

[57] ABSTRACT

A toner cartridge comprising a toner container body having an opening and a mouth ring member provided at the opening. The mouth ring member has a bonding and non-bonding region where the sealing film is attached at the bonding region. A lid is supported under the sealing film by the non-bonding region in such a manner that when the sealing film is peeled off, the lid slides and allows the toner to dispense into the toner box.

13 Claims, 3 Drawing Sheets

TONER CARTRIDGE

BACKGROUND OF THE INVENTION

1. Field of the Invention

This invention relates to a toner cartridge which is detachably mounted on a toner box of a copier/duplicator or a printer to supply toner into the latter.

2. Description of the Related Art

There are available a variety of toner cartridges that are detachably mounted on the toner box. Toner cartridges, that are mounted on the toner box after opening are well known in the art. However, a toner box of this type is disadvantageous in that in the process of mounting it on the toner box, the toner is often scattered, thus contaminating the surrounding area. In order to eliminate this difficulty, toner cartridges have teen proposed, for instance, by Japanese Patent Application (OPI) No. 224364/1983 (the term "OPI" as used herein means an unexamined published application"), and Japanese Utility Model Application (OPI) No. 77151/1983, where the cartridges are opened after being mounted on the toner box. Another toner cartridge is proposed by this inventor in U.S. Pat. No. 4,834,246.

One example of a conventional toner cartridge is shown in FIGS. 8, 9 and 10. FIG. 8 is a sectional view of the cartridge, FIG. 9 is a sectional view taken along line A—A of FIG. 8, and FIG. 10 provides a bottom view for a description of the opening of the conventional toner cartridge. The conventional toner cartridge comprises a toner container body 1 that has an opening at the bottom and is substantially in the form of a rectangular box. A mouth ring member 2 has a bonding region 8 along the opening edge to which a sealing film 4 is bonded. The mouth ring member 2 also holds a lid 3 in such a manner that the lid is slidable. The sealing film seals the opening in such a manner that it can be peeled off when necessary. At one nd of the opening, a locking member 11 is present to secure one end of the sealing film and the lid for the opening. Toner 6 is contained in the toner container body, which is covered with a top plate 7. The sealing film is bonded to the bonding region of the mouth ring member, thus supporting the toner. One end portion of the sealing film, is folded over one end portion of the lid, and secured to the locking member 11. The locking member 11 is slidably provided over the rear surface of the lid and the lid is slidably held by a side wall 10, which is integral with the mouth ring member.

The toner is supplied by the conventional toner cartridge as follows. First, the toner cartridge is mounted or the toner inlet of the toner box. Then, the locking member is moved in the direction of the arrow of FIG. 8 with a suitable means (not shown) to peel the sealing film off the opening of the toner container body thereby opening the latter. As a result, toner is supplied to the toner box from the toner container body.

In the conventional toner cartridge described above, the bonding region of the mouth ring member is adjacent to the opening. If the toner cartridge is dropped during transportation or handling, it often occurs that the sealing film falls off, or is damaged or punctured by the impact of dropping, resulting in toner leaking out of the toner cartridge. This difficulty may be eliminated by strongly bonding the sealing film to the bonding region but this results in requiring greater power to peel off the sealing film to supply the toner, resulting in a toner supplying operation that cannot be easily or smoothly carried out.

Accordingly, an object of the present invention is to provide a toner cartridge that has the seemingly contradictory characteristics of allowing the peeling of the sealing film to be easily and smoothly performed while providing a toner cartridge configuration that reduces damage to the sealing film as a result of accidental dropping of the toner cartridge during handling or transportation.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided a toner cartridge comprising a toner container body having an opening at the bottom and a mouth ring member provided at the opening and having a bonding region to which a sealing film is bonded. The sealing film is adapted to seal the opening in such a manner that the sealing member can be easily peeled off when required. A lid is supported under the sealing film in such a manner that the lid is slidable with respect to the toner container body in the direction of the peeling off of the sealing film. According to the invention, the mouth ring member has a non-bonding region that is extended inwardly from the entire inner edge of the bonding region.

In the toner cartridge according to the present invention, the non-bonding region may be formed in various manners. However, it is preferable that it is created by a tapered protruded portion of the mouth ring member. The non-bonding region extends radially along the lower end portion of the inner wall of the toner container body. The distance between the non-bonding region and the bonding region, that is, the width of the non-bonding region, is 2 mm or more.

The bonding region should be designed so that the sealing film is not strongly bonded thereto. This requirement may be met by reducing the area of the bonding region. However, it is preferable to employ, instead of the above-described method of merely reducing the area of the bonding region, a method in which a non-bonding groove is formed in the bonding region along the entire circumference, or the bonding region is cut or made wavy in such a manner that large bonding areas and small bonding areas occur alternately in the bonding region, whereby the tension is maintained in a horizontal direction.

In the conventional toner cartridge, the bonding region of the mouth ring member is adjacent to the opening thereof, as was described above. Therefore, when it is dropped, the impact is vertically directed on the sealing edge of the sealing film. A force acts on the sealing section at an angle of 90° and the sealing film becomes damaged and readily falls off. On the other hand, in the toner cartridge of the present invention, the mouth ring member has a non-bonding region that defines the edge of the opening of the toner cartridge. Therefore, when it is dropped, the impact is not vertically directed on the sealing edge of the sealing film, rather, the force is directed onto the non-bonding region and dissipated by the mouth ring member and the container body itself. Any force resulting from the drop acting on the sealing section is minimized.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

FIG. 7(*b*) is a sectional view of a second embodiment of a toner cartridge of the present invention where the tapered protrusion portion of the mouth ring member, forming the non-bonding region, is replaced by a rectangular section;

DESCRIPTION OF THE PREFERRED EMBODIMENT

Reference will now be made in detail to the present preferred embodiments of the invention as illustrated in the accompanying drawings.

Figure 1:
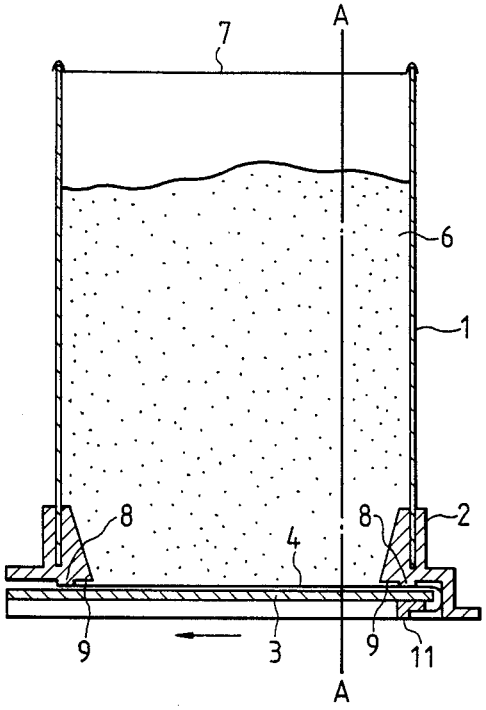
FIG. 1 is a sectional view showing one embodiment of a toner cartridge according to the invention.
Figure 2:
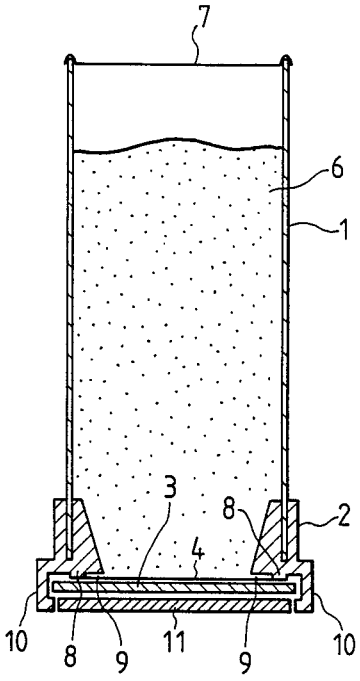
FIG. 2 is a sectional view taken along line A—A of FIG. 1.
Figure 3:
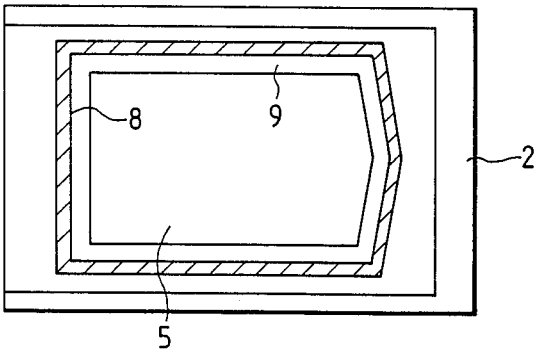
FIG. 3 is a bottom view showing the toner cartridge of FIG. 1 where the sealing film has been peeled back and the cartridge opened.

In FIGS. 1, 2, and 3, reference numeral 1 designates a toner container body having an opening 5 at the bottom. The toner container body may be made of paper or plastic. The top of the toner container body is covered with a top plate 7 that may be made of a tin plate or the like, so that toner 6 is put in the toner container body with the top plate. The lower end of the toner container body is engaged with a mouth ring member 2 having a tapered inner wall. The mouth ring may be molded from polystyrene.

The mouth ring member has a bonding region 8, which extends radially around the opening, to which a sealing film 4 is bonded. Adjacent to the sealing film is a lid 3. The tapered inner wall mentioned above is projected radially inward, thus providing a non-bonding region 9 in such a manner that the non-bonding region is located inside the bonding region and defines the edge of the opening. In other words, the bonding region and the non-bonding region are provided on the end face of the mouth ring member in such a manner as to define the opening. In order to facilitate the operation of bonding the sealing film to the bonding region formed on the end face of the mouth ring member, it is desirable that the bonding region is protruded above the non-bonding region by an amount of not more than about 0.5 mm.

Further, the sealing film is used to seal the opening in such a manner that it can be readily peeled off when necessary. The sealing film is bonded to the bonding region. The sealing film is made, as an example, of polypropylene. One end portion of the sealing film, is folded over one end portion of the lid and secured to a locking member which is slidably provided over the rear surface of the lid. The lid is made, as an example, of a thin plate of polypropylene, and it is slidably supported by a side wall 10 which is integral with the mouth ring member 2.

The distance between the lid and the sealing film should be reduced as much as possible with the condition that the resulting lid is able to be readily moved by the sealing film when supplying the toner. The distance between the lid and the sealing film should be about 1 mm or less, more preferably 0.5 mm or less.

The toner cartridge thus constructed according to the present invention is used as follows. First, it is mounted on the toner box. For this purpose, as an example, the toner box is designed to have a movable member (not shown) with which the locking member is engaged, so that, as the movable member is moved, the locking member is moved, and accordingly the lid is moved. That is, as the movable member is moved, the locking member engaged therewith is moved in the direction of the arrow of FIG. 1, and accordingly the lid is moved in the same direction. As the lid is moved in this manner, the sealing film is gradually peeled off to open the toner container body, as a result of which the toner is supplied into the toner box.

After the toner has been supplied into the toner box, and the now emptied toner container is to be replaced, the movable member of the toner box is moved in the direction opposite to the arrow of FIG. 1, and the toner cartridge is then removed from the toner box.

Figure 4:
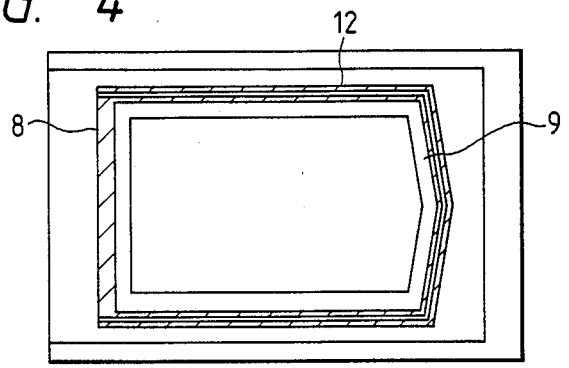
FIG. 4 is a bottom view of an embodiment of a toner cartridge of the present invention where a groove is formed in the bonding region.
Figure 5:
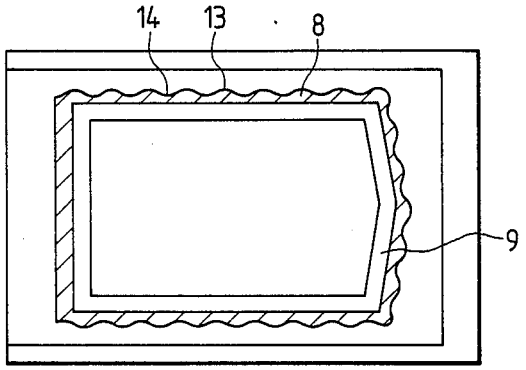
FIG. 5 is a bottom view of a second embodiment of a toner cartridge of the present invention where the outer edge of the bonding region is wavy.
Figure 6:
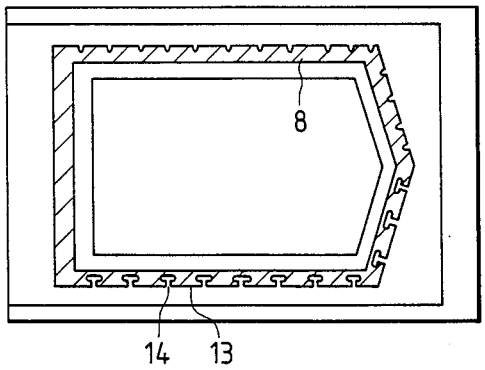
FIG. 6 is a bottom view of a third embodiment of a toner cartridge of the present invention where a number of cuts are formed in the bonding region.

FIGS. 4, 5 and 6 are bottom views of differing embodiments of the toner cartridge of this invention from which the lid and the sealing film have been removed. The FIGures provide examples of varied configurations of the sealing section of the toner cartridge. In the example shown in FIG. 4, a groove is formed in the bonding region 8. In the example of FIG. 5, the outer edge of the bonding region 8 is wavy, and in the example of FIG. 6, a number of cuts are formed in the bonding region 8; that is, in each of FIGS. 5 and 6, the bonding region 8 has large (large area) bonding areas 13 and small (reduced area) bonding areas 14 occurring alternately. In each of the examples shown, the non-bonding region 9 is provided inside the bonding region 8 in such a manner as to extend radially inward from the bonding region 8. The width of the non-bonding region 9 is preferably 2 mm or more.

In the invention of the present application, the bonding region can be formed as shown in FIG. 4, 5 or 6, with the result that the sealing film bonding strength is reduced. Because of the presence of the non-bonding region, in the case when the toner cartridge is dropped during handling or transportation, the impact force will not be directed on the seal edge in the vertical direction to cause a break in the seal.

Figure 7A:
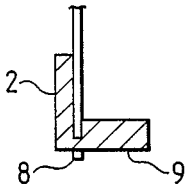
FIG. 7(*a*) is a sectional view of an embodiment of a toner cartridge of the present invention where the tapered protrusion portion of the mouth ring member, forming the non-bonding region, is replaced by a flat plate-shaped protruded portion.
Figure 7B:
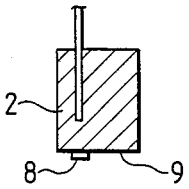
Figure 8:
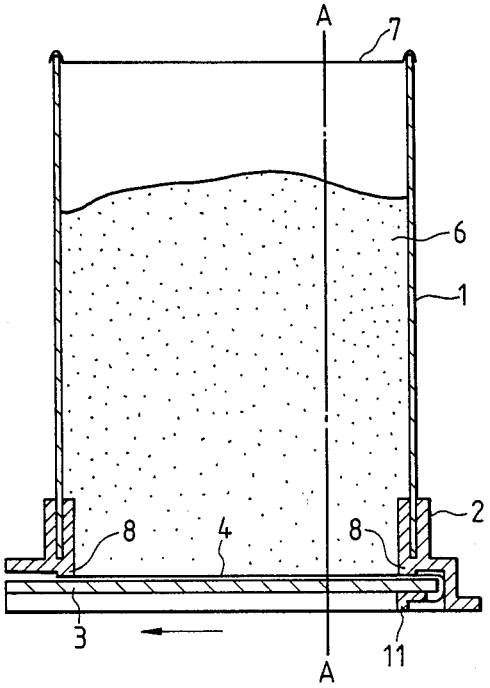
FIG. 8 PRIOR ART
FIG. 8 is a sectional view showing one example of a conventional toner cartridge.
Figure 9:
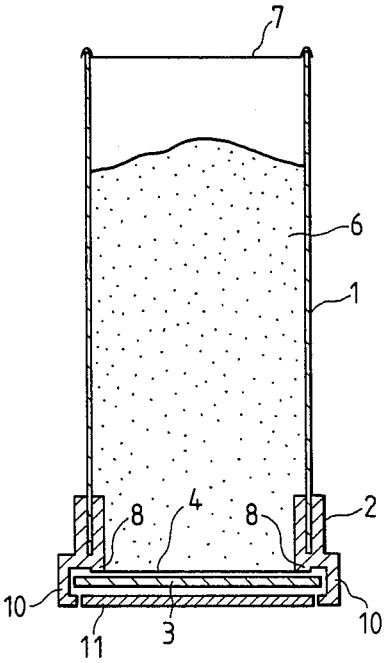
FIG. 9 PRIOR ART
FIG. 9 is a sectional view taken along line A—A of FIG. 8.
Figure 10:
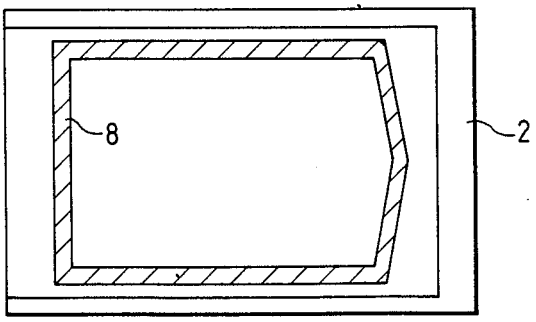
FIG. 10 PRIOR ART
FIG. 10 is a bottom view of the conventional toner of FIG. 8 where the sealing film has been peeled back and the cartridge opened.

As shown in FIGS. 1 and 2, the non-bonding region 9 is provided by the tapered protruded portion of the mouth ring member which forms the inner wall thereof; however, the invention is not limited thereto or thereby. For instance, it may be provided by a flat plate-shaped protruded portion as shown in FIG. 7(*a*), or a protruded portion that is rectangular in section as shown in FIG. 7(*b*). However, it is preferable to employ the mouth ring member having the tapered inner wall as shown in FIGS. 1 and 2, because in the case of the example of FIGS. 7(*a*) or (*b*), after the toner cartridge is emptied, residual toner particles may remain on the protruded portion of the mouth ring member and be wasted. It is further preferable that the tapered inner wall form an angle of 20° or less with the axis of the mouth ring member.

The present invention is now illustrated in greater detail with reference to Examples and Comparative Examples, but it should be understood that the present invention is not deemed to be limited thereto.

COMPARATIVE EXAMPLE 1

A toner cartridge having an opening of 60×120 mm, a bonding region 2.6 mm in width provided adjacent to the opening, and a sealing film bonded by heat was formed. The toner cartridge thus formed was dropped from a height of 1 m. As a result, the sealing film was damaged, and toner was scattered.

EXAMPLE 2

The toner cartridge in Example 1 was modified as follows: The bonding region was modified into one which was 3 mm in width and had a groove therein, and a non-bonding region that was 5 mm in width and was provided inside the bonding region. A sealing film was bonded to the bonding region by heat sealing. The modified toner cartridge was dropped from a height of 1 m. In this case, the sealing film was not damaged, and it functioned normally and could be readily peeled off when it was required to supply the toner to the toner box. (The force required to peel off the sealing film in a horizontal direction was 600 g. In the case of Example 1, the force ranged from 800 g to 1000 g.)

EXAMPLE 3

A toner cartridge was formed which contained 200 g of toner and had an opening 40×90 mm, and in which a non-bonding region 2 mm in width was formed inside a bonding region 2.6 mm in width having a groove, and a sealing film was bonded to the bonding region by heat sealing. The toner cartridge thus formed was dropped from a height of 1 m high. The sealing film was not damaged and it could be readily peeled off when it was required to supply the toner to the toner box.

In the toner cartridge according to the invention, as described above, the mouth ring member has a non-bonding region which is extended radially inward from the entire bonding region. Therefore, the cartridge is free from the difficulty that, when it is dropped, the impact is directed to the sealing edge of the sealing film in the vertical direction. Moreover, the required peeling force acting on the sealing section is small.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit of scope of the general inventive concept as defined by the appended claims and their equivalents.

What is claimed is:

1. A toner cartridge comprising:

a toner container body having an opening at the bottom and an inner wall having a lower end portion;

a mouth ring member provided at said opening and having a bonding region to which a sealing film is bonded and having a non-bonding region which extends radially inward from the entire inner edge of said bonding region, said bonding region protruding above said non-bonding region, said bonding region protruding above said non-bonding region and having an inner edge, and said sealing film being adapted to seal said opening in such a manner that said sealing member can be peeled off said bonding region in a direction relative to said toner container body when required; and a lid supported under said sealing film in such a manner that said lid is slidable with respect to said toner container body in said direction relative to said toner body.

2. A toner cartridge according to claim 1, wherein said non-bonding region is formed by a tapered protruded portion of said mouth ring member and is located at the lower end portion of the inner wall of said toner container body.

3. A toner cartridge according to claim 2, wherein said tapered protruded portion of said mouth ring member forms an angle of 20° or less with an axis of said mouth ring member.

4. A toner cartridge according to claim 1, wherein said non-bonding region is formed by a flat plate-shaped protruded portion of said mouth ring member and is located at the lower end portion of the inner wall of said toner container body.

5. A toner cartridge according to claim 1, wherein said non-bonding region is formed by a rectangular protruded portion of said mouth ring member and is located at the lower end portion of the inner wall of said toner container body.

6. A toner cartridge according to claim 5, wherein said bonding region has a wavy contour.

7. A toner cartridge according to claim 5, wherein said bonding region has cuts along the contour thereof.

8. A toner cartridge according to claim 1, wherein said bonding region has a non-bonding groove formed over the whole circumference thereof.

9. A toner cartridge according to claim 1, wherein said bonding region is made up of large bonding areas and small bonding areas provided alternately.

10. A toner cartridge according to claim 1, wherein said non-bonding region is 2 mm or more in length.

11. A toner cartridge according to claim 1, wherein said bonding region is protruded above the non-bonding region not more than a distance of 0.5 mm.

12. A toner cartridge according to claim 1, wherein the distance between said lid and said sealing film is 1 mm or less.

13. A toner cartridge according to claim 1, wherein the distance between said lid and said sealing film is 0.5 mm or less.

* * * * *